US005257614A

United States Patent [19]

Sullivan

[11] Patent Number: 5,257,614

[45] Date of Patent: Nov. 2, 1993

[54] GAS POWERED GUN

[76] Inventor: Brian Sullivan, 517 N. Mountain Ave., Upland, Calif. 91786

[21] Appl. No.: 916,527

[22] Filed: Jul. 20, 1992

[51] Int. Cl.[5] ..... F41B 11/06

[52] U.S. Cl. ..... 124/73; 124/74

[58] Field of Search ..... 124/74, 73, 72, 70–71, 124/75, 76, 56, 65–67

[56] References Cited

U.S. PATENT DOCUMENTS

| | | | |
|---|---|---|---|
| 964,810 | 7/1910 | Rieger | 124/65 |
| 3,199,501 | 8/1965 | Bertschinger | 124/74 X |
| 3,204,625 | 9/1965 | Shepherd . | |
| 3,494,344 | 2/1970 | Vadas et al. | 124/74 |
| 3,572,310 | 3/1971 | Chiba | 124/76 |
| 3,788,298 | 1/1974 | Hale | 124/76 |
| 4,531,503 | 7/1985 | Shepherd | 124/76 |
| 4,936,282 | 6/1990 | Dobbins et al. | 124/74 |
| 5,078,118 | 1/1992 | Perrone | 124/74 |

FOREIGN PATENT DOCUMENTS

| | | | |
|---|---|---|---|
| 1264128 | 1/1990 | Canada | 124/67 |

*Primary Examiner*—Randolph A. Reese

*Assistant Examiner*—Harry C. Kim

*Attorney, Agent, or Firm*—Denton L. Anderson

[57] ABSTRACT

What is provided is an improved gas-powered gun for projecting lightweight projectiles, such as paint balls. Like guns presently available on the market, the gun of the invention has a handle, a barrel, a projectile chamber within the barrel, a bolt disposed within the barrel immediately rearward of the projectile chamber, a hammer disposed immediately rearward of the bolt, a spring for propelling the hammer rearwardly during the firing operation, a pressure chamber which retains a discreet amount of a pressurized gas and a valve for releasing the pressurized gas to the projectile chamber upon impact from the hammer. The improved gun of the invention differs from the gun presently on the market by the fact that the improved gun has a guide tube attached to the hammer. The guide tube extends into a bore within the bolt and is dimensioned in close tolerance to the bore within the bolt. The guide tube thereby is capable of sliding smoothly within the bore of the bolt to provide support for the hammer as it is propelled rearwardly during the firing operation.

20 Claims, 6 Drawing Sheets

GAS POWERED GUN

BACKGROUND OF THE INVENTION

This invention relates generally to gas powered guns suitable for projecting lightweight projectiles, and, specifically, to gas powered guns suitable for projecting paint balls.

BACKGROUND

Gas powered guns suitable for projecting lightweight projectiles have been in existence for some time. Within the last 15 years, gas powered guns adapted to project a semi-solid ball of paint have become very popular for playing out simulated combat games among adults. Typically, the "paint balls" used in such games weigh about 0.11 ounces and are about 0.7 inches in diameter. Such simulated combat games have become highly sophisticated, organized affairs. The number of adults who regularly participate in such paint ball competitions number in the hundreds of thousands.

A very common style of paint gun presently in use is shown diagrametrically in FIGS. 1A and 1B. This prior art gun comprises (I) a handle; (II) a barrel attached to the handle, the barrel having a central bore with a forward end which is in communication with the exterior of the gun, a rearward end and a longitudinal axis; (III) a projectile repository attached to the barrel; (IV) a projectile chamber disposed within the central bore of the barrel and in communication with the forward end of the central bore of the barrel; (V) projectile insertion means for removing a projectile from the projectile repository and placing it into the projectile chamber; (VI) a bolt disposed within the central bore of the barrel rearward of the projectile chamber, the bolt having a central bore which is in communication with the projectile chamber and which has a longitudinal axis which is coaxial with the longitudinal axis of the barrel; (VII) a hammer slidably disposed within the central bore of the barrel immediately rearward of the bolt, the hammer having a forward end, a rearward end and a central bore, the central bore having a longitudinal axis which is coaxial with the central bore of the barrel; (VIII) cocking means for attaching the hammer to the bolt; (IX) trigger means for detaching the hammer from the bolt; (X) a pressure chamber affixed within the rearward end of the central bore of the barrel, the pressure chamber being in communication with a source of pressurized gas; (XI) valve means affixed immediately forward of the pressure chamber for releasing a discrete quantity of pressurized gas from the pressure chamber into the central bore of the barrel; and (XII) spring means for urging the hammer away from the bolt and into contact with the valve means.

As can be seen in FIGS. 1A and 1B, the prior art gun further comprises a relatively long valve tube which extends through the central bore of the hammer and into the central bore of the bolt. When this prior art gun is fired, the hammer is propelled rearwardly towards the valve means, sliding along the interior of the barrel, independent of the valve tube.

The problem with this prior art gun is that the hammer does not slide smoothly within the central bore of the barrel during the cocking process and, more importantly, does not slide smoothly during the firing process. This is because there is a certain amount of "play" between the external surface of the hammer and the internal surface of the barrel. Because of this "play," the hammer does not slide within the central bore of the barrel smoothly but, instead, tends to wobble. This is especially true in the most common form of the gun shown in FIGS. 1A and 1B in which the hammer is attached to the bolt by a sear attached on only one side of the bolt. In such an embodiment, when the trigger is pulled and the sear releases the hammer from the bolt, a rotational moment is imparted to the hammer (in the direction away from the sear attachment point) by the action of the hammer spring against the hammer. Consequently, the hammer tends to wobble as it is propelled rearwardly towards the valve means.

The non-smooth action of the hammer as it is slid during the cocking operation is unsatisfying to the user. More importantly, the non-smooth action of the hammer during the firing operation causes undue wear on the gun internals. This is because a hammer which wobbles during the firing operation grates against the interior surface of the barrel. Furthermore, a hammer which wobbles does not consistently strike the gas release valve mechanism. The rear-most surface of the hammer tends to strike the forward-most surface of the valve means in a non-flush manner. This places a high amount of stress on localized areas of the rear-most surface of the hammer and the forward-most surface of the gas release valve and results in premature failures of the hammer and/or gas release valve.

The failure of the hammer to consistently strike the gas release valve in a flush manner during firing also causes the valve means to release gas from the pressure chamber inconsistently from firing to firing, i.e., each firing causes a slightly different volume of gas to escape through the gas release valve (because the gas release valve is actuated in a non-flush manner) and causes the gas to be released in a slightly different direction (not always precisely down the center of the gas release tube) from firing to firing. This results in a reduction in accuracy.

Accordingly, there is a need for an inexpensive gas powered gun suitable for projecting lightweight projectiles in which the hammer slides smoothly during cocking and firing. There is a further need for such a gun wherein, during firing, the hammer strikes the valve means in a consistent and flush manner. Finally, there is a need for such a gun having increased accuracy.

SUMMARY

The invention satisfies these needs. The invention is an improved gas powered gun suitable for projecting lightweight projectiles such as paint balls wherein the hammer is caused to smoothly slide within the barrel, both during cocking and during firing. The gun is also simpler and less expensive to manufacture and assemble.

The invention is a gun comprising: (I) a handle, (II) a barrel attached to the handle, the barrel having a central bore with a forward end which is in communication with the exterior of the gun, a rearward end and a longitudinal axis; (III) a projectile repository attached to the barrel; (IV) a projectile chamber disposed within the central bore of the barrel and in communication with the forward end of the central bore of the barrel; (V) projectile insertion means for removing a projectile from the projectile repository and placing it into the projectile chamber; (VI) a bolt disposed within the central bore of the barrel rearward of the projectile chamber, the bolt having a central bore which is in communication with the projectile chamber and which has a longitudinal axis which is coaxial with the longitudinal axis of the barrel; (VII) a hammer slidably disposed within the central bore of the barrel immediately rearward of the bolt, the hammer having a forward end, a rearward end and a central bore, the central bore having a longitudinal axis which is coaxial with the central bore of the barrel; (VIII) cocking means for attaching the hammer to the bolt; (IX) trigger means for detaching the hammer from the bolt; (X) a pressure chamber affixed within the rearward end of the central bore of the barrel, the pressure chamber being in communication with a source of pressurized gas; (XI) valve means affixed immediately forward of the pressure chamber for releasing a discrete quantity of pressurized gas from the pressure chamber into the central bore of the barrel; (XII) spring means for urging the hammer away from the bolt and into contact with the valve means; (XIII) gas release actuation means for actuating the valve means and releasing the discrete quantity of gas, the gas release actuation means having a gas release tube for receiving the discrete quantity of pressurized gas, the gas release tube being affixed to the valve means between the valve means and the hammer, the gas release tube having (1) a longitudinal axis which is coaxial with the longitudinal axis of the central bore of the barrel, and (2) a hammer engagement surface for engaging and cooperating with the rearward end of the hammer in such a way that the gas release tube communicates with the central bore of the hammer; and (XIV) a guide tube having a forward end slidably disposed within the central bore of the bolt and a rearward end attached to the hammer in such a way as to be in communication with the central bore of the hammer, the guide tube also having (1) a longitudinal axis which is coaxial with the longitudinal axis of the central bore of the barrel and (2) a length which is greater than the distance between the hammer and the hammer engagement surface of the gas release tube when the hammer is attached to the bolt.

In a preferred embodiment of the invention, the guide tube and the central bore of the bolt are cylindrical and the difference in their respective diameters is between about 0.001 and 0.008 inches.

DESCRIPTION OF THE DRAWINGS

These and other features, aspects and advantages of the present invention will become understood with reference to the following description, appended claims and accompanying drawings, wherein:

1A is a side view in partial cutaway of a gas powered gun of the prior art;

Figure 1A:
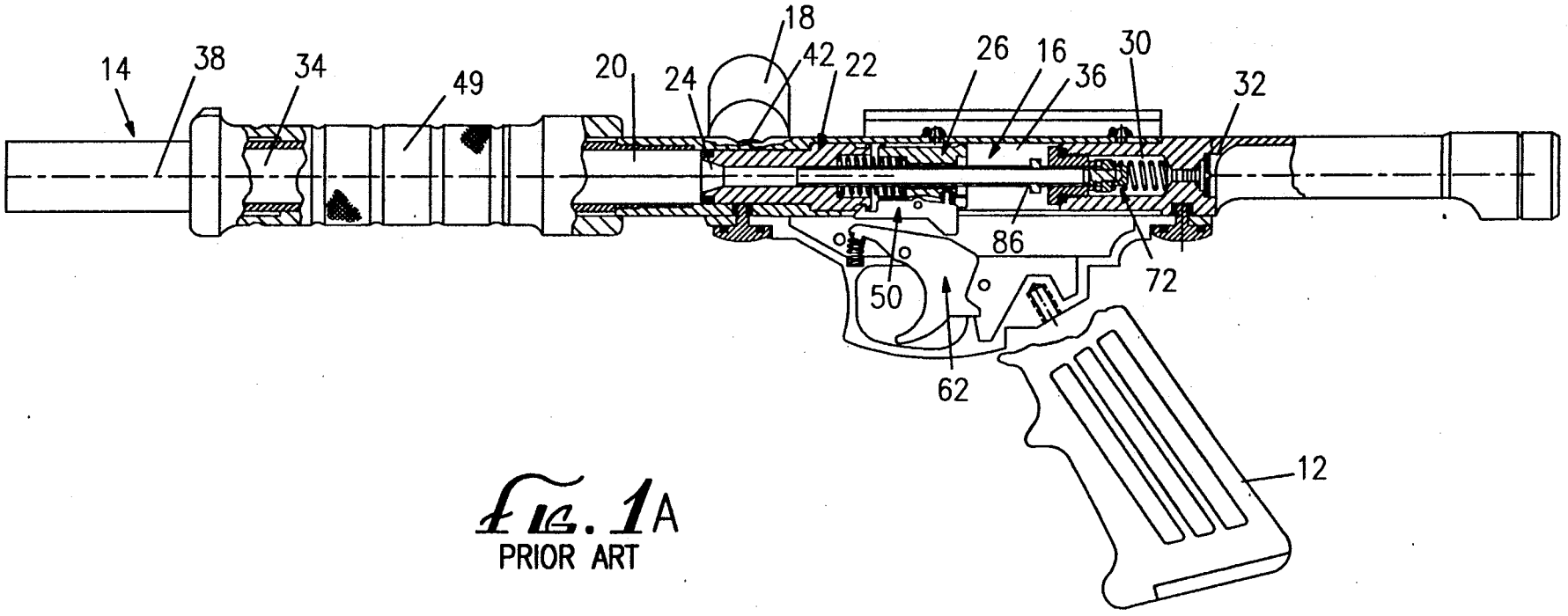
Fig. 1A PRIOR ART
Figure 2:
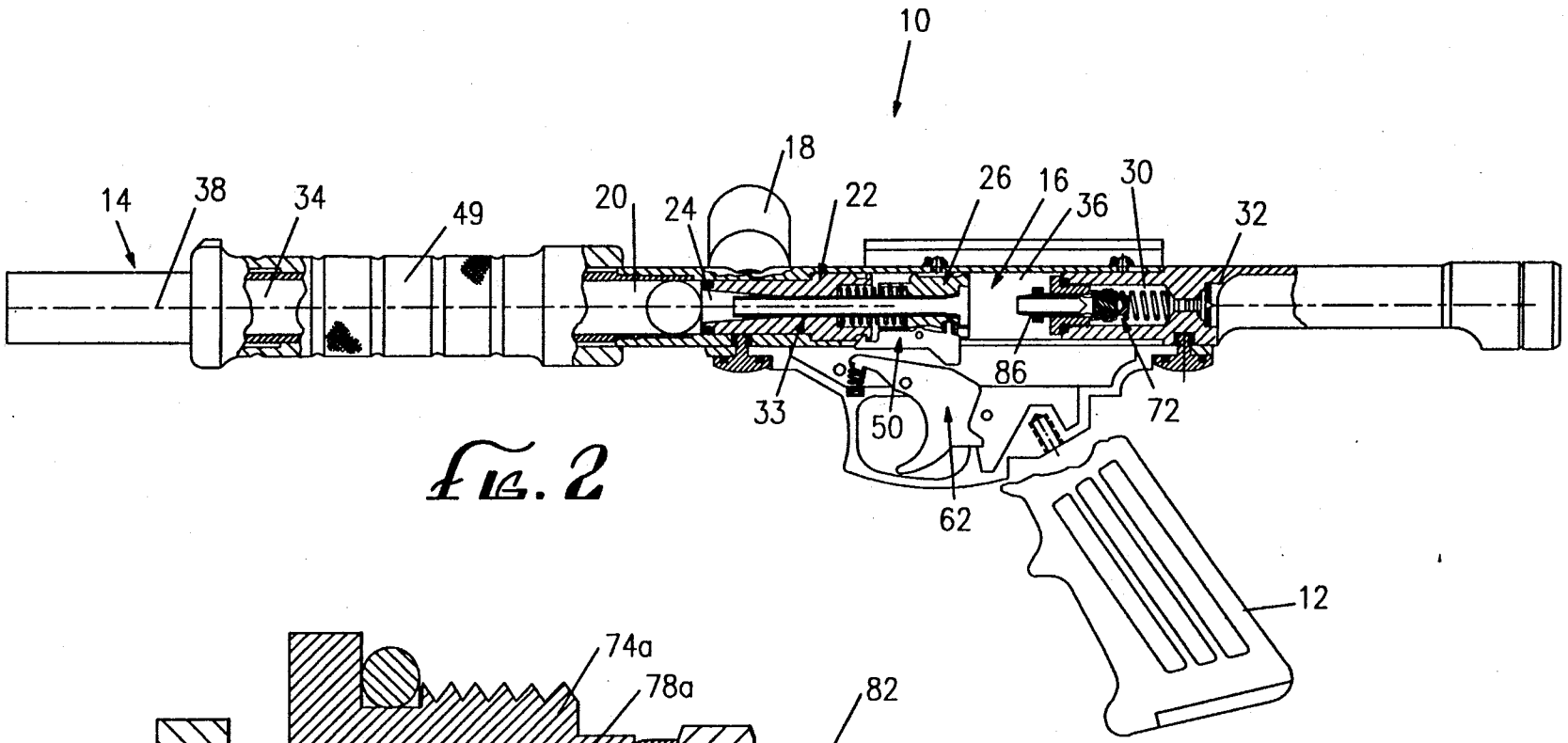
Figure 6:
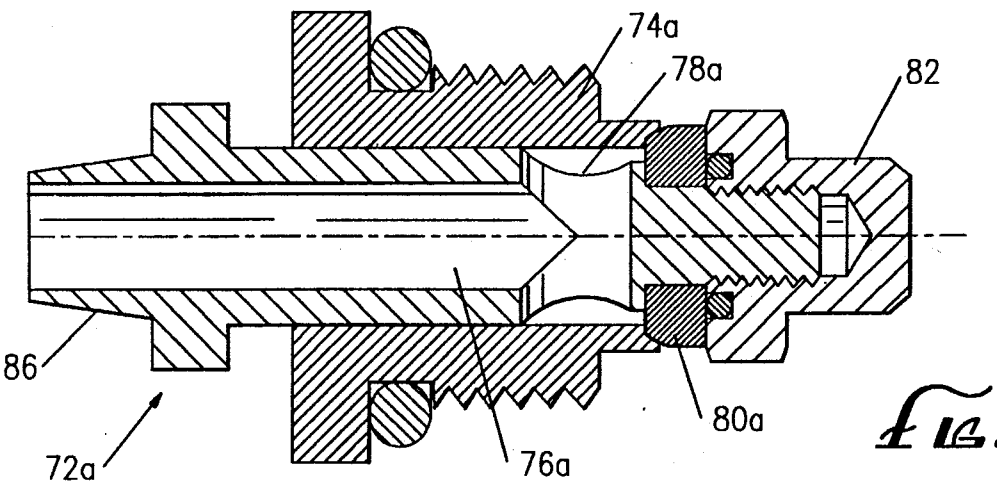
Figure 3:
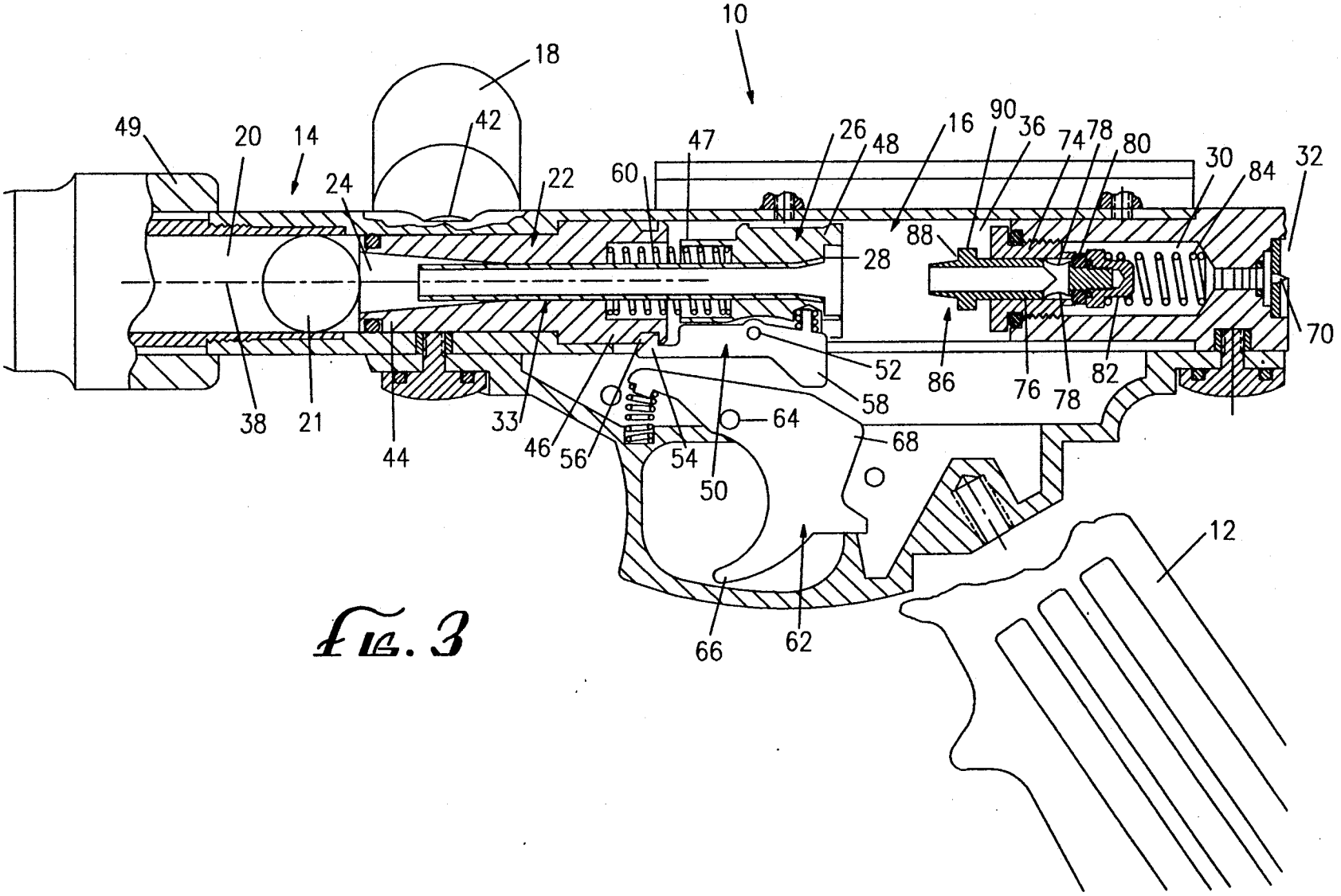
Figure 4:
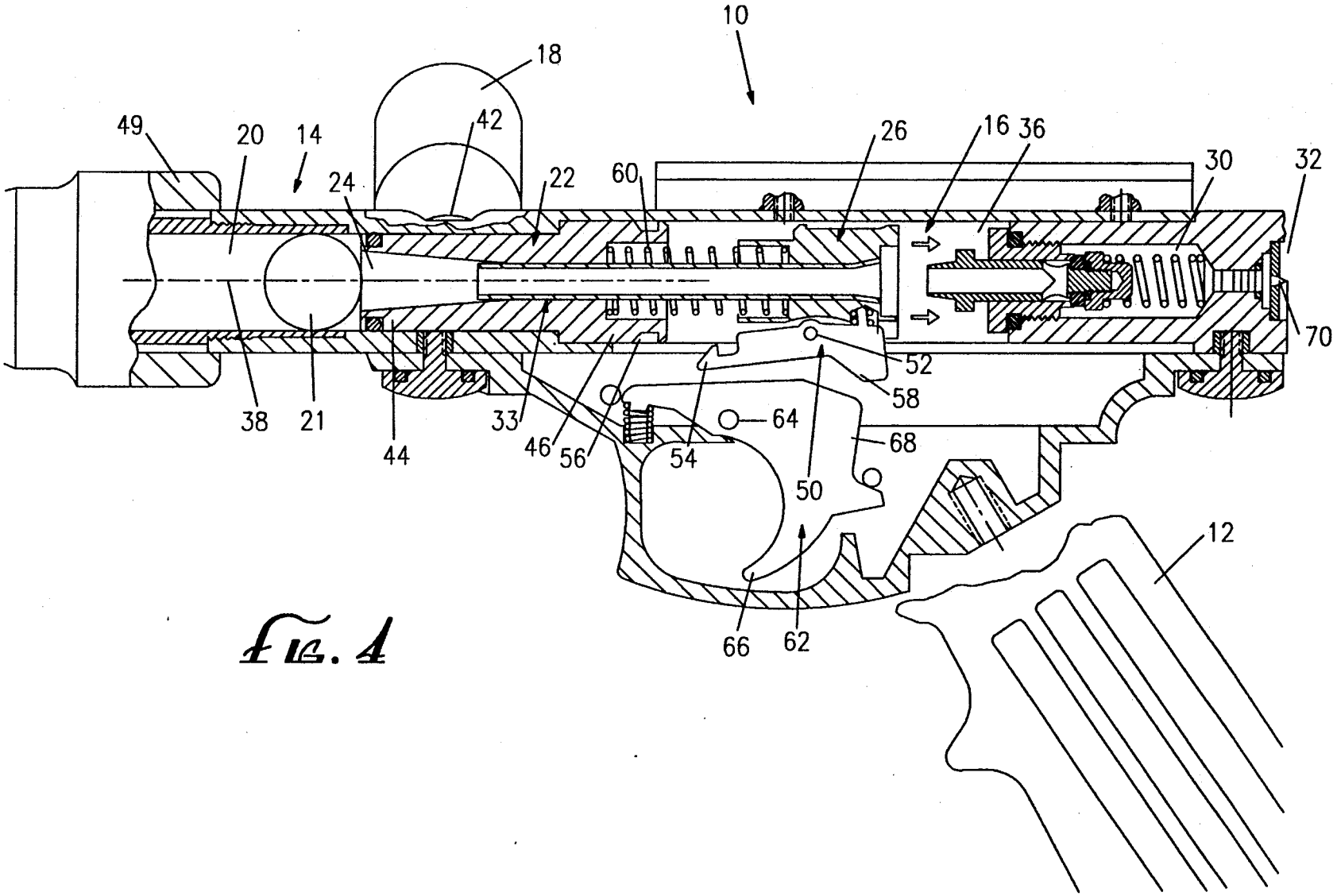
Figure 5:
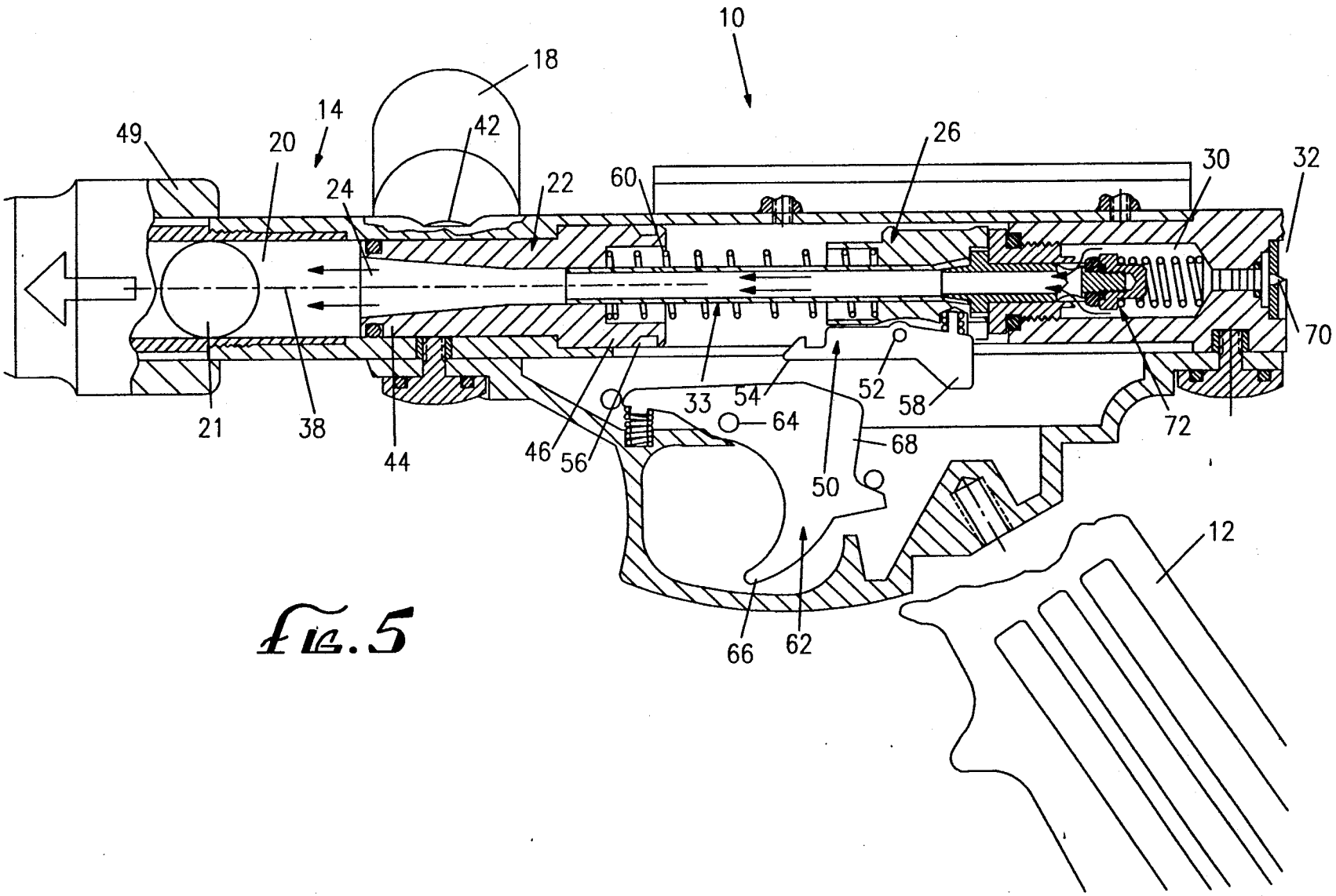

1B is a detailed view in partial cross-section of gas powered gun shown in FIG. 1A;

FIG. 2 is a side view in partial cutaway of a gas powered gun having features of the invention;

FIG. 3 is a detailed view in partial cross-section of the gas powered gun shown in FIG. 2 wherein the hammer is in a ready-to-file position;

FIG. 4 is a detailed view in partial cross-section of the gas gun shown in FIG. 2 wherein the hammer is shown during the firing operation;

FIG. 5 is a detailed view in partial cross-section of the gas powered, gun shown in FIG. 2 wherein the components of the gun are shown as they exist immediately after the gun is fired; and FIG. 6 is a detailed cross-sectional view of an alternative pressure seal usable in the invention.

DESCRIPTION OF THE INVENTION

The invention is an improvement to a gas powered gun which is suitable for projecting lightweight projectiles, such as paint balls. An embodiment of the invention is shown in FIGS. 2-5.

Figure 1B:
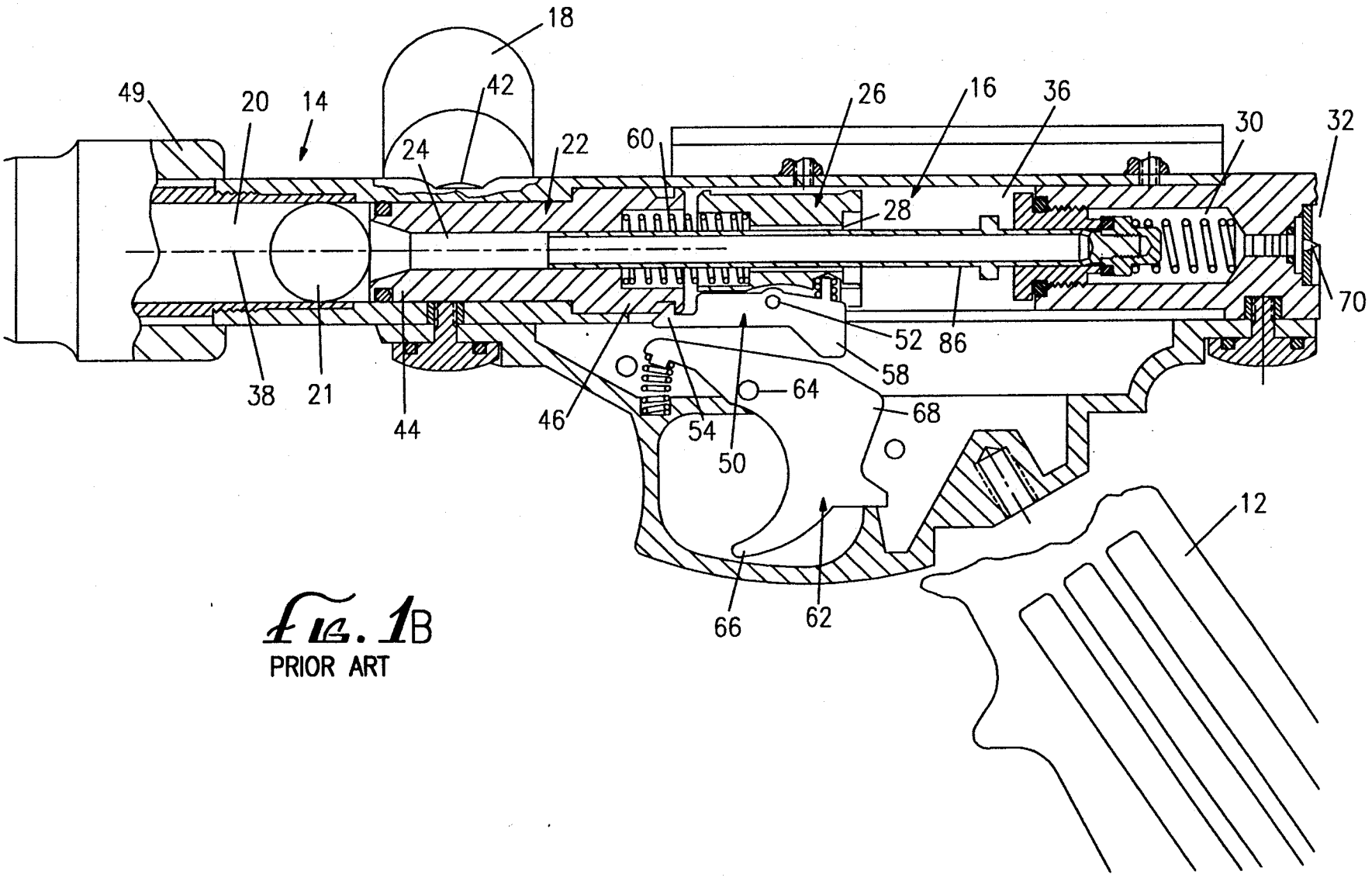
Fig. 1B PRIOR ART

As discussed in the Summary section, the gas powered gun of the invention 10 is an improvement over the prior art gas powered gun shown in FIGS. 1A and 1B. Both the gun of the invention 10 and the prior art comprises: (I) a handle 12, (II) a barrel 14, having a central bore 16, (III) a projectile repository 18 attached to the barrel 14, (IV) a projectile chamber 20 disposed within the central bore 16 of the barrel 14, (V) projectile insertion means for removing a projectile 21 from the projectile repository 18 and placing it into the projectile chamber 20, (VI) a bolt 22 affixed within the central bore 16 of the barrel 14 rearward of the projectile chamber 20, the bolt 22 having a central bore 24 which is in communication with the projectile chamber 20, (VII) a hammer 26 slidably disposed within the central bore 16 of the barrel 14 immediately rearward of the bolt 22, the hammer 26 having a central bore 28, (VIII) cocking means for attaching the hammer 26 to the bolt 22, (IX) trigger means for detaching the hammer from the bolt 22, (X) a pressure chamber 30 affixed within the central bore 16 of the barrel 14, the pressure chamber being in communication with a source of pressurized gas 32, (XI) valve means affixed immediately forward of the pressure chamber 30 for releasing a discrete quantity of pressurized gas from the pressure chamber 30 into the central bore 16 of the barrel 14, and (XII) spring means for urging the hammer 26 away from the bolt 22 and into contact with the valve means.

The improvement of the invention comprises the further addition to the above-described prior art gas powered gun: a novel gas release actuation means in combination with a novel guide tube 33.

In the gun of the invention 10, the handle 12 can be of any shape suitable for gripping by the user. The handle 12 can be made out of any suitable material, including metals, plastics and woods.

The barrel 14 is a hollow cylinder typically made of steel. The barrel 14 can, however, be made of other suitable materials capable of withstanding the structural and pressure forces present during cocking and firing. The central bore 16 of the barrel 14 has a forward end 34 which is in communication with the exterior of the gun 10 and a rearward end 36. The barrel 14 also has a longitudinal axis 38.

The projectile repository 18 is attached to the exterior of the barrel 14. The projectile repository 18 can be any suitable container vessel capable of holding one or more of the lightweight projectiles 21.

The projectile chamber 20 is disposed within the central bore 16 of the barrel 14. The projectile chamber 20 is in communication with the forward end 34 of the central bore 16 of the barrel 14.

The projectile insertion means for removing a projectile 21 from the projectile repository 18 and placing it into the projectile chamber 20 can be any of the many suitable insertion means known in the art. Projectile insertion means whereby a projectile 21 is urged into the projectile chamber 20 by spring means or gas pressure means can be used. In the embodiment shown in the drawings, the projectile insertion means comprises a feed tube 42 which is in communication with both the projectile repository 18 and the projectile chamber 20.

The projectile repository 18 is disposed above the projectile chamber 20 so that the lightweight projectile 21 will gravitate from the projectile repository 18 to the projectile chamber 20 via the feed tube 42.

The bolt 22 is disposed within the central bore 16 of the barrel 14 rearward of the projectile chamber 20. The bolt 22 has a forward end 44 and a rearward end 46. The central bore 24 of the bolt 22 is in communication with the projectile chamber 20. The central bore 24 of the bolt 22 has a longitudinal axis which is coaxial with the longitudinal axis 38 of the barrel 14. In a preferred embodiment, the cross-sectional area of the central bore 24 of the bolt 22 in the forward end 44 of the bolt 22 is greater than cross-sectional area of the central bore 24 at the rearward end 46 of the bolt 22.

In the embodiment shown in the drawings, the bolt 22 is slidably disposed within the central bore 16 of the barrel 14, and is slidable between a first, forward-most bolt position wherein the bolt 22 blocks the communication between the feed tube 42 and the projectile chamber 20 and a second, rearward-most bolt position wherein the bolt 22 does not block the communication between the feed tube 42 and the projectile chamber 20.

The bolt 22 can be made of any suitable material, such as a plastic or a light metal.

The hammer 26 is slidably disposed within the central bore 16 of the barrel 14 immediately rearward of the bolt 22. The hammer 26 has a forward end 47 and a rearward end 48. The central bore 28 of the hammer 26 has a longitudinal axis which is coaxial with the longitudinal axis 38 of the barrel 14. The hammer 26 can be made of any suitable material having sufficient mass to actuate the valve means described below and must be made of a material strong enough to withstand the mechanical and pressure forces generated during operation. In a typical embodiment, the hammer is made out of a metal, such as a steel.

The cocking means can be any of the many cocking means known generally in the art. In the embodiment shown in the drawings, the cocking means comprises a pump handle 49 disposed on the exterior of the barrel 14 so as to be slidable along the barrel 14. The pump handle 49 is mechanically engaged to the bolt 22 which is slidably disposed within the bore 16 of the barrel 14. The pump handle 49 can be slid along the exterior of the barrel 14 rearwardly so that the bolt 22 is slid between the first bolt position and the second bolt position. The stroke of the pump handle 49 is determined principally by the size of the projectile 21. The cocking means in the embodiment shown in the drawings further comprises a sear 50 which is swivably attached to the hammer 26 by a sear pivot 52. The sear 50 has a latch 54 which is adapted to engage a notch 56 defined by the exterior surface of the rearward end 46 of the bolt 22. When the latch 54 is engaged within the notch 56, the bolt 22 is held firmly in close proximity to the hammer 26. The sear 50 also comprises a sear cam 58 which cooperates during the firing operation with the trigger means, described below.

The spring means for urging the hammer 26 away from the bolt 22 is provided in the embodiment shown in the drawings by a hammer spring 60 disposed between the hammer 26 and the bolt 22. The hammer spring 60 is so disposed that, when the hammer 26 is attached to the bolt 22 by the sear 50, the hammer spring 60 is in compression. The hammer spring 60 can be of any suitable strength. Typically, the hammer spring 60 has a spring tension between about 3 pounds and about 12 pounds.

The trigger means for detaching the hammer 26 from the bolt 22 is provided in the embodiment shown in the drawings by a trigger 62 which is swivably attached on a trigger pivot 64. The trigger 62 is shaped with (1) a trigger projection 66 for contact with the user's finger, and (2) a trigger cam 68 which is disposed in close proximity to the sear cam 68. As can be seen from FIGS. 3–5, when the trigger projection 66 is pulled by the finger of a user, the trigger cam 68 rotates upwardly and contacts the sear cam 58. By this action, the sear 50 is caused to rotate about the sear pivot 52 so as to cause the latch 54 to disengage from the notch 56 of the bolt 22.

The pressure chamber 30 is affixed within the rearward end 36 of the central bore 16 of the barrel 14. The pressure chamber 36 is in communication with a source of pressurized gas 32, such as a pressurized $CO_2$ canister. The pressure chamber 36 should be constructed so as to withstand at least about 300 psig., preferably 800 psig, and most preferably 2000 psig. As shown in the embodiment of the drawings, a piercing pin 70 is used to release gas from a gas canister 32 into the pressure chamber 30.

The pressurized gas can be one any of the several inexpensive, noncorrosive gases. Carbon dioxide is most typically used as a pressurized gas. Pressurized air and pressurized nitrogen can also be used.

The valve means for releasing a discreet quantity of pressurized gas from the pressure chamber 30 is affixed immediately forward of the pressure chamber 30 in the central bore 16 of the barrel 14. As shown in FIG. 2, the valve means is provided by a pressure release valve 72. The pressure release valve 72 comprises a valve seat 74, a valve tube 76 having at least one valve port 78, a sealing ring 80 and a backing nut 82. In a typical embodiment, the pressure release valve 72 has two valve ports 78, each being about 0.18 inches in diameter. Spring means, shown in the drawings as a valve spring 84, are provided to urge the backing nut 82 against the sealing ring 80 to cover and seal the ports 78. Typically, the valve spring 84 exerts between about 3 and about 12 pounds of force.

FIG. 6 shows an alternative pressure release valve 72 useful in the invention. In this alternative pressure release valve 72*a*, the valve seat 74*a* defines a flared opening having a frustoconical-shaped opening. A sealing ring 80*a* is especially dimensioned to fit within this frustoconical-shaped opening.

The gas release actuation means for actuating the valve means and releasing a discreet quantity of gas from the pressure chamber comprises a gas release tube 86 for receiving the discreet quantity of pressurized gas. The gas release tube 86 is affixed to the valve tube 76 between the valve tube 76 and the hammer 26. Alternatively, as shown in the embodiment in the drawings, the valve tube 76 and the gas release tube 86 are one and the same continuous structure. The gas release tube 86 has a longitudinal axis which is coaxial with the longitudinal axis 38 of the central bore 16 of the barrel 14. The gas release tube 86 also has a hammer engagement surface 88 for engaging and cooperating with the rearward end 48 of the hammer 26. In the embodiment shown in the drawings, the hammer engagement surface 88 is provided by a shoulder 90 defined on the external surface of the gas release tube 86.

The gas release tube 86 is disposed within the valve means in such a way that, when the rearward end 48 of the hammer 26 is driven rearwardly within the central bore 16 of the barrel 14 by the force of the spring means, the kinetic energy of the hammer 26 is transferred to the gas release tube 86 by the engagement of the rearward end 48 of the hammer 26 and the hammer engagement surface 88.

Accordingly, when the gun 10 is fired and the hammer 26 is urged rearwardly into contact with the hammer engagement surface 88, the gas release tube 86 presses rearwardly against the valve tube 76. This pressure tends to open the ports 78 by pushing the sealing ring 80 and the backing nut rearwardly against the counteracting pressure of the spring means. As the ports 78 are opened, a discreet quantity of pressurized gas stored within the pressure chamber 30 is released through the ports 78.

The guide tube 33 can be made from any suitable material which can withstand the forces associated with continual sliding contact with the interior surface of the central bore 24 of the bolt 22. In a typical embodiment, the gas release tube is made of a steel and the combined mass of the hammer 26, sear 50, and guide tube 33 is between about 2 and 3 ounces, preferably between about 1.5 and about 1.9 ounces.

The guide tube 33 is adapted to slide smoothly within the central bore 24 of the bolt 22. Preferably, the exterior surface of the guide tube 33 is dimensioned to be in close tolerance with the central bore 24 of the bolt 22. In a most preferred embodiment, the exterior surface of the guide tube is cylindrical as is the central bore 24 of the bolt 22 and the difference between the outside diameter of the guide tube 33 and the inside diameter of the central bore 24 of the bolt 22 is less than about 0.01 inches, most preferably between about 0.002 inches and 0.005 inches.

Where the exterior surface of the guide tube 33 is cylindrical, the length of the guide tube 33 should be at least twice the outside diameter of the guide tube 33.

In a typical embodiment, the interior surface of the guide tube 33 is cylindrical and has a diameter between about 0.12 inches and about 0.22 inches. Also in a typical embodiment, the exterior surface of the guide tube 33 is cylindrical and has an outside diameter of between about 3/8 of an inch and 11/16 of an inch.

In a preferred embodiment, the guide tube 33 is disposed within the central bore 28 of the hammer 26. In a most preferred embodiment, the guide tube 33 is press fit into the central bore 28 of the hammer 26 from the forward end 47 of the hammer 26. In this most preferred embodiment, the guide tube 33 can be firmly held within the central bore 28 of the hammer 26 by swagging the rearward-most end of the guide tube 33 to a mating taper within the central bore 28 of the hammer 26 in the rearward end 48 of the hammer 26.

FIGS. 2–5 illustrate a typical firing sequence for the invention 10. FIG. 3 shows the gun 10 in the ready-to-fire position with a lightweight projectile 21 disposed within the projectile chamber 20. The hammer 26 is attached to the bolt 22 by the sear 50. The hammer spring 60 is in compression. When the trigger projection 66 is pulled rearwardly by the user, the trigger 62 rotates around the trigger pivot 64 causing the trigger cam 68 to engage the sear cam 58. This action causes the sear 50 to rotate about the sear pivot 52 disengaging the latch 54 from the notch 56. As illustrated in FIG. 4, the hammer 26 is thereby released from the bolt 22 and the hammer spring 60 urges the hammer 26 rearwardly toward the gas release tube 86. As shown in FIG. 5, as the rearward end 48 of the hammer 26 contacts the hammer engagement surface 88 of the gas release tube 86, the gas release tube 86 is urged rearwardly against the counter-pressure exerted by the valve spring 84. This action causes the sealing ring 80 to be displaced rearwardly away from the valve ports 78 so that pressurized gas within the pressure chamber 30 is released through the valve port 78 and into the valve tube 76. A pressure wave is thereby caused to propagate through the valve tube 76, through the gas release tube 86, through the guide tube 33, through the central bore 24 of the bolt 22 and into the projectile chamber 20. This pressure energy is imparted to the lightweight projectile 21 which is thereby urged forwardly out through the forward end 34 of the central bore 16 of the barrel 14.

As can be seen from a comparison of FIG. 1A and FIG. 2, the improved gun of the invention 10 differs principally from the prior art gun by the fact that the elongated gas release tube 86 of the prior art has been replaced in the improved gun of the invention 10 by a shortened gas release tube 86 which is adapted to cooperate with the central bore 28 of the hammer 26 and the guide tube 33. After the gun is fired and gas is released into the gas release tube 86, the gas release tube 86, the central bore 28 of the hammer 26 and the guide tube 33 cooperate to provide a single, continuous conduit leading into the central bore 24 of the bolt 22. During the firing operation, the guide tube 33 slides smoothly within the central bore 24 of the bolt 22 to guide the hammer 26 rearwardly smoothly and without wobble. The hammer 26 in the prior art gun wobbles during the firing operation because it is only "guided" by the interaction of the interior surface of the barrel 14 and the exterior surface of the hammer 26. This "guidance" has been found to be most imperfect, causing excessive wear on the hammer 26 and the gas release tube 86 and inaccuracy in operation. The hammer 26 in the gun of the invention 10, slides on the other hand, smoothly rearwardly towards the gas release tube 86, guided by the close cooperation between the guide tube 33 and the central bore 24 of the bolt 22. In the improved gun of the invention 10, the hammer 26, therefore, always strikes the hammer engagement surface 88 of the gas release tube 86 in a "flush" manner. This minimizes wear and tear on the hammer exterior and on the hammer/gas release tube interface, and results in a consistent quantity of gas being released from the valve means.

Although the present invention has been described in considerably detail with reference to certain preferred versions, many other versions should be apparent to those skilled in the art. Therefore, the spirit and scope of the appended claims should not necessarily be limited to the description of the preferred versions contained therein.

What is claimed is:

1. An improved gas powered gun suitable for projecting light weight projectiles such as paint balls, the gun comprising:

(I) a handle;

(II) a barrel attached to the handle, the barrel having a central bore with a forward end which is in communication with the exterior of the gun, a rearward end and a longitudinal axis;

(III) a projectile repository attached to the barrel;

(IV) a projectile chamber disposed within the central bore of the barrel and in communication with the forward end of the central bore of the barrel;

(V) projectile insertion means for removing a projectile from the projectile repository and placing it into the projectile chamber;

(VI) a bolt disposed within the central bore of the barrel rearward of the projectile chamber, the bolt having a forward end and a rearward end central bore which is in communication with the projectile chamber and which has a longitudinal axis which is coaxial with the longitudinal axis of the barrel;

(VII) a hammer slidably disposed within the central bore of the barrel immediately rearward of the bolt, the hammer having a forward end, a rearward end and a central bore, the central bore having a longitudinal axis which is coaxial with the central bore of the barrel;

(VIII) cocking means for attaching the hammer to the bolt;

(IX) trigger means for detaching the hammer from the bolt;

(X) a pressure chamber affixed within the rearward end of the central bore of the barrel, the pressure chamber being in communication with a source of pressurized gas;

(XI) valve means affixed immediately forward of the pressure chamber for releasing a discrete quantity of pressurized gas from the pressure chamber into the central bore of the barrel; and (XII) spring means for urging the hammer away from the bolt and into contact with the valve means;

the improvement comprising:

a. gas release actuation means for actuating the valve means and releasing the discrete quantity of gas, the gas actuation means having a gas release tube for receiving the discrete quantity of pressurized gas, the gas release tube being affixed to the valve means between the valve means and the hammer, the gas release tube having (1) a longitudinal axis which is coaxial with the longitudinal axis of the central bore of the barrel and (2) a hammer engagement surface for engaging and cooperating with the rearward end of the hammer in such a way that the gas release tube communicates with the central bore of the hammer; and b. a guide tube having a forward end slidably disposed within the central bore of the bolt and a rearward end attached to the hammer in such a way as to be in communication with the central bore of the hammer, the guide tube also having (1) a longitudinal axis which is coaxial with the longitudinal axis of the central bore of the barrel and (2) a length which is greater than the distance between the hammer and the hammer engagement surface of the gas release tube when the hammer is attached to the bolt.

2. The gas powered gun of claim 1 wherein the projectile insertion means comprises a feed tube which communicates with the projectile chamber and wherein the projectile repository is disposed above the projectile chamber so that a lightweight projectile within the projectile repository can be caused to gravitate into the projectile chamber via the feed tube.

3. The gas powered gun of claim 2 wherein the bolt is slidable within the barrel between a first bolt position wherein the bolt blocks communication between the feed tube and the projectile chamber and a second bolt position wherein the bolt does not block communication between the feed tube and the projectile repository.

4. The gas powered gun of claim 1 wherein the cross-sectional area of the central bore in the forward end of the bolt is greater than the cross-sectional area of the central bore at the rearward end of the bolt.

5. The gas powered gun of claim 1 wherein the cocking means comprises sear means swivably attached to the hammer for detachably coupling the hammer to the bolt.

6. The gas powered gun of claim 5 wherein the combined mass of the hammer, sear and guide tube is between about 1 and about 3 ounces.

7. The gas powered gun of claim 5 wherein the combined mass of the hammer, sear and guide tube is between about 1.5 and about 1.9 ounces.

8. The gas powered gun of claim 7 wherein the trigger means comprises a trigger projection which is swivably attached proximate to the sear when the sear is attached to the bolt, the trigger means further comprising a trigger cam attached to the trigger projection which can be swiveled into contact with the sear when the sear is attached to the bolt in such a way that the trigger cam detaches the sear from the bolt.

9. The gas powered gun of claim 5 wherein the cocking means further comprises pump handle means slidably attached to the exterior of the barrel for sliding the bolt rearwardly within the bore of the barrel so as to become attached to the sear.

10. The gas powered gun of claim 1 wherein the pressure chamber is adapted to retain gas under 800 psi of pressure.

11. The gas powered gun of claim 1 wherein the pressure chamber is adapted to retain gas under 2,000 psi of pressure.

12. The gas powered gun of claim 1 wherein the valve means comprises a cup seal.

13. The gas powered gun of claim 1 wherein the valve means comprises a valve seat having a rearward opening which flares outwardly and comprising an impulse seal which cooperates with the rearward opening of the valve seat.

14. The gas powered gun of claim 1 wherein the spring means comprises a spring disposed between the bolt and the hammer.

15. The gas powered gun of claim 14 wherein the spring can impart between about 3 pounds and about 12 pounds of force.

16. The gas powered gun of claim 1 wherein the guide tube is cylindrical and has a length which is at least twice its outside diameter.

17. The gas powered gun of claim 1 wherein the central bore of the guide tube is cylindrical and has an interior diameter between about 0.12 inches and about 0.22 inches.

18. The gas powered gun of claim 17 wherein the guide tube is press fit into the hammer and is flared outwardly within the central bore of the hammer towards the rearward end of the hammer.

19. The gas powered gun of claim 1 wherein the guide tube is disposed within the central bore of the hammer.

20. The gas powered gun at claim 1 wherein the exterior surface of the guide tube is cylindrical and the interior surface of the central bore of the bolt in the rearward end of the bolt is cylindrical and wherein the difference between the outside diameter of the guide tube and the inside diameter of the central bore of the bolt in the rearward end of the bolt is between about 0.002 inches and about 0.005 inches.

* * * * *